US007713128B2

(12) United States Patent
Bailey

(10) Patent No.: US 7,713,128 B2
(45) Date of Patent: May 11, 2010

(54) HEADPHONE PLUG WITH THE PLAYER TRACKER

(76) Inventor: Donald L. Bailey, 3511 N. Front St., Harrisburg, PA (US) 17110

( * ) Notice: Subject to any disclaimer, the term of this patent is extended or adjusted under 35 U.S.C. 154(b) by 594 days.

(21) Appl. No.: 11/797,169

(22) Filed: May 1, 2007

(65) Prior Publication Data

US 2008/0076575 A1 Mar. 27, 2008

Related U.S. Application Data

(60) Provisional application No. 60/796,192, filed on May 1, 2006.

(51) Int. Cl.
*A63F 9/24* (2006.01)
*H04R 25/00* (2006.01)

(52) U.S. Cl. ..... 463/41; 463/25; 381/74

(58) Field of Classification Search ..... 463/25, 463/35, 41; 705/26; 706/11, 12; 235/462.41, 235/462.12; 381/107; 273/142 K, 143 R, 273/138.1

See application file for complete search history.

(56) References Cited

U.S. PATENT DOCUMENTS

| | | | |
|---|---|---|---|
| 6,113,495 | A | 9/2000 | Walker et al. |
| 6,302,790 | B1 | 10/2001 | Brossard |
| 6,416,411 | B1 | 7/2002 | Tsukahara |
| 6,729,618 | B1 | 5/2004 | Koenig et al. |
| 6,846,238 | B2 | 1/2005 | Wells |
| 6,942,574 | B1 | 9/2005 | LeMay et al. |
| 2002/0018074 | A1 | 2/2002 | Buil et al. |
| 2002/0142846 | A1 | 10/2002 | Paulsen |
| 2003/0017870 | A1 | 1/2003 | Klein |
| 2003/0054881 | A1 | 3/2003 | Hedrick et al. |
| 2003/0119575 | A1 | 6/2003 | Centuori et al. |
| 2003/0195043 | A1 | 10/2003 | Shinners et al. |
| 2005/0043090 | A1 | 2/2005 | Pryzby et al. |

(Continued)

FOREIGN PATENT DOCUMENTS

JP 2005-185502 7/2005

(Continued)

OTHER PUBLICATIONS

"Jukebox Casino Vegas Slot Machine" http://cgi.ebay.com/ws/eBayISAPI.d11?ViewItem&item=6153797939&category=3948 retrieved on Jan. 23, 2006.

(Continued)

*Primary Examiner*—Peter DungBa Vo
*Assistant Examiner*—Masud Ahmed
(74) *Attorney, Agent, or Firm*—Richard C. Litman

(57) ABSTRACT

The jukebox for casino gaming machines provides a casino gaming machine that has at least one device for playback of audio, and may include a video display for playback of multimedia files. A separate central server in operable communication with a gaming machine client has access to player account information, as well as music, graphics and themes. The client communicates with a jukebox player. The jukebox player accepts and responds to user commands via a user interface. Earphones and earphone plugs are provided. The earphones and plugs host a debit/credit and player tracking system. The earphones and plugs communicate with an enabling device in the casino to allow a user to experience a selected entertainment program in its entirety while the user is operating the gaming machine.

1 Claim, 5 Drawing Sheets

U.S. PATENT DOCUMENTS

2005/0085300 A1 4/2005 Johnson
2005/0096125 A1 5/2005 LeMay et al.
2005/0153768 A1 7/2005 Paulsen
2005/0164786 A1 7/2005 Connelly
2005/0201568 A1* 9/2005 Goyal ..... 381/74
2005/0211768 A1 9/2005 Stillman
2005/0239546 A1 10/2005 Hedrick
2005/0277469 A1 12/2005 Pryzby et al.
2006/0025206 A1 2/2006 Walker et al.
2007/0036368 A1* 2/2007 Hettinger et al. ..... 381/107

FOREIGN PATENT DOCUMENTS

WO WO 2005/026883 3/2005

OTHER PUBLICATIONS

"The Next Generation of Slot Machines" http://brokopp.casinocitytimes.com/articles/571.html retrieved on Jan. 23, 2006.

* cited by examiner

HEADPHONE PLUG WITH THE PLAYER TRACKER

CROSS-REFERENCE TO RELATED APPLICATION

This application claims the benefit of U.S. Provisional Patent Application Ser. No. 60/796,192, filed May 1, 2006.

BACKGROUND OF THE INVENTION

1. Field of the Invention

The present invention relates to casino gaming machines and to the delivery of user-selectable recorded music while playing on a casino gaming machine, and particularly to a jukebox on a casino gaming machine that provides a system and method for providing an electronic jukebox for the individualized delivery of musical entertainment to a patron of a slot machine, video poker machine, or other casino gaming machine, or to a patron of an online gambling site.

2. Description of the Related Art

Gambling casinos provide a wide variety of games of chance to attract customers. Traditionally casinos were furnished with rows of mechanically operated slot machines. Players would crank the levers and wait for the dials to stop spinning. Mechanical slot machines could be quite noisy. Most modern casinos have replaced mechanical slot machines with electrically operated slot machines, which are much quieter in operation. In addition, several new electronic gaming machines are available for the solo player, such as video poker. Instead of the traditional coin slot, electronic gaming machines may use a tracking device to charge a player's account for each game and to credit the player's account with winnings.

A player tracking device is used to provide player tracking services to a player wishing to participate in a player tracking program. Typically, up until now, a player is issued a magnetically striped player tracking card that may be fed into a card reader on the gambling machine.

Once accepted, player information contained on the card is used by the casino to track a user's play on the machine. Based on proprietary player tracking rules, a player may be awarded account credits and incentives to encourage continued play on the machine. The player tracking credits and/or debits and incentives may be stored in a database connected to the player tracking server. The card is usually updated so that the player may travel throughout the casino and play other machines, yet still be credited with historical player tracking data.

If a player does not provide the casino gambling machine with a player tracking card, the player may lose out on valuable credits and incentives, notwithstanding intensive use of the participating establishment's gambling machines. Moreover, the casino loses out on detailed marketing intelligence regarding the player's usage of their machines.

However, magnetic cards may be easily lost or misplaced, and the magnetic strip may become damaged. Moreover, the quiet operation of the machines do little to enhance the player's excitement and level of enthusiasm. It would be desirable to provide each gaming machine with an individualized music delivery system that permits the player to choose his or her musical selections, to listen to the selections without disturbing players at adjacent machines, and to deliver the music in a manner that permits the casino to charge for providing the music delivery system in a convenient manner.

Thus, a jukebox on a casino gaming machine solving the aforementioned problems is desired.

SUMMARY OF THE INVENTION

The jukebox for casino gaming machines provides a casino gaming machine that has at least one device for playback of audio, and may include a video display for playback of multimedia files. A separate central server in operable communication with a gaming machine client has access to player account information, as well as music, graphics and themes. The client communicates with a jukebox player. The jukebox player accepts and responds to user commands via a user interface. Earphones and earphone plugs are provided. The earphones and plugs host a debit/credit and player tracking system. The earphones and plugs communicate with the server, which debits the player's account for playing back selections from the jukebox based upon account identification from the tracking system.

In an online version, a web page is provided to allow the user to select and experience an entertainment program in its entirety during operational modes of a casino game on a web-enabled device.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
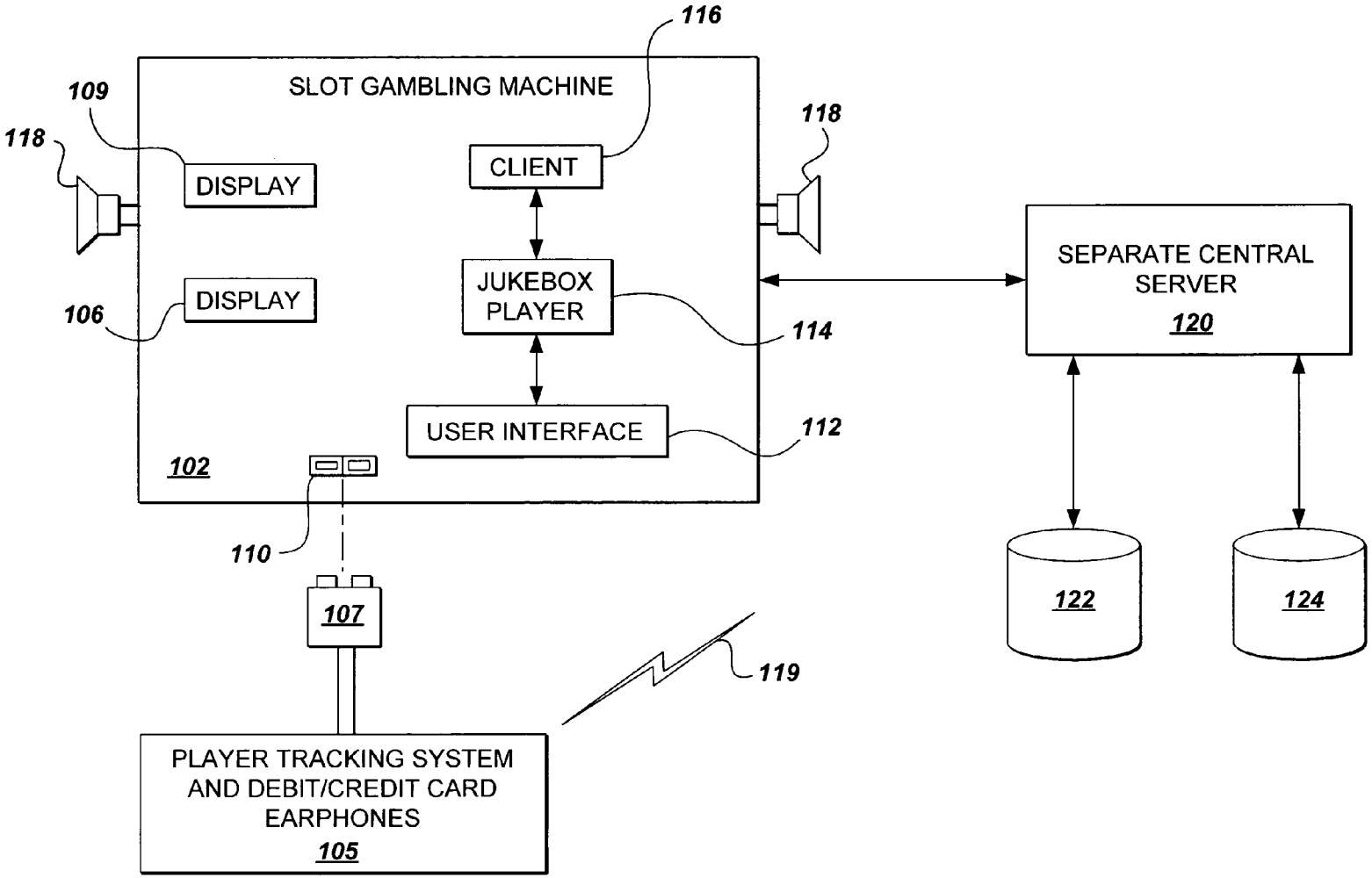
FIG. 1 is a block diagram of a system for providing a jukebox on a casino gaming machine according to the present invention.

As shown in FIG. 1, the present invention provides a casino gaming machine 102 that has at least one audio playback device, and preferably has at least one video display device 109 capable of playback of multimedia files. A separate central server 120 may be in operable communication with a gaming machine client 116. The separate central server 120 may have access to player or user account information, as well as a jukebox function comprising music, graphics and themes. The user account information may be stored in an account database 122. Similarly, the music, graphics, and themes information may be stored in a multimedia database 124.

The client 116 communicates with a jukebox player 114. The jukebox player 114 may be a CD player, an AM/FM tuner, a VHS player, a DVD player, an MP3 player, a musical jukebox, a video jukebox, a computer, a server, or alternatively a media software application, such as, e.g., Windows Media Player®. The jukebox player 114 may be stored on the gaming machine or in a central location separate from the gaming machine 102. The jukebox player 114 accepts and responds to user commands via a user interface, such as, for example, user interface 112. User interface 112 provides the user with the capability to preview and listen to, or download songs, music videos, movies, and the like, on at least one of the display screens 109 or 106 on the casino gaming machine 102.

In addition to speakers 118, earphones 105 and earphone plugs 107 provide a user with the capability to listen to musical songs from the jukebox player 114. The earphones 105 and plugs 107 may provide a debit/credit and player tracking system. Plugs 107 may have an electronic circuit or chip programmed in the same manner as a traditional plastic player club tracking card, thus providing the user with the capability to use the earphones as a credit card to play the games on machine 102. The earphones 105 and plugs 107 may communicate via wired, such as a USB cable or other plug connection 110, or wireless 119 interface, with an enabling device in the casino to allow a user to experience a selected entertainment program in its entirety while the user is operating the casino gaming machine 102. The enabling device may be the casino gaming machine 102 or some other device located within the casino.

Figure 2:
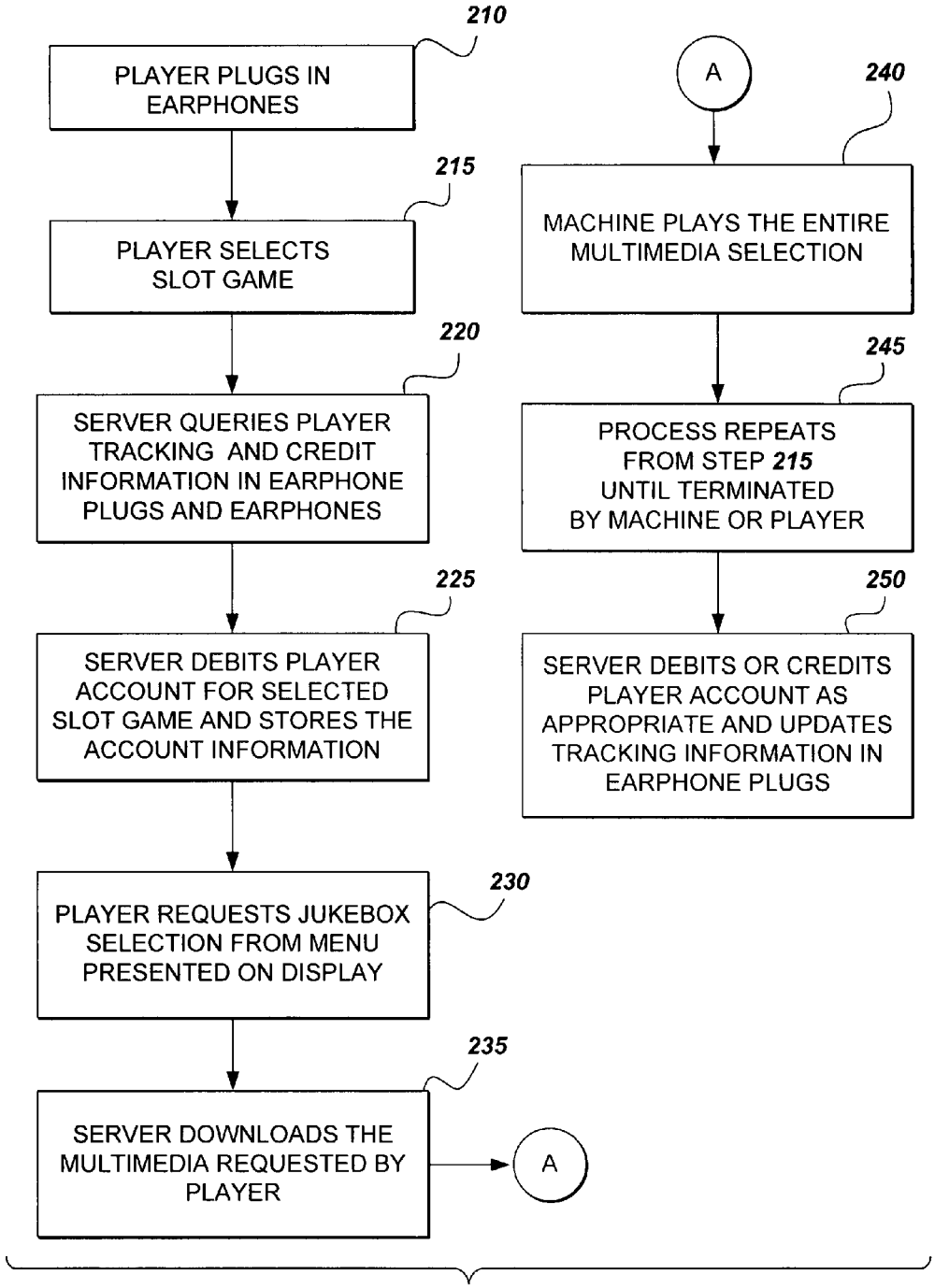
FIG. 2 is a flowchart of a method for providing a jukebox on a casino gaming machine according to the present invention.

As shown in FIG. 2, at step 210, a player, i.e., user, may first plug in earphones 105 using plugs 107 and plug receptacle 110 at casino gaming machine 102. At step 215, the player can select a game, which may be a slot game, video poker game, or other gambling game capable of being presented by machine 102.

As shown in FIG. 2, step 220 the server 120 may query the player tracking and credit information in earphone plugs 107 and player earphones 105. At step 225, the server 120 may adjust the player account for a selected game, and then store the account information.

Account adjustments may be based on the player tracking information and player game request. At step 230 the player can request a jukebox selection from a menu presented on the display 106 or alternate display 109. At step 235, the server 120 downloads the entertainment content requested by the player or user. At step 240 the machine 102 plays the entire entertainment content selected by the user. As shown in step 250, the server 120 adjusts and updates player account and tracking information upon termination of the session with the user.

Figure 3:
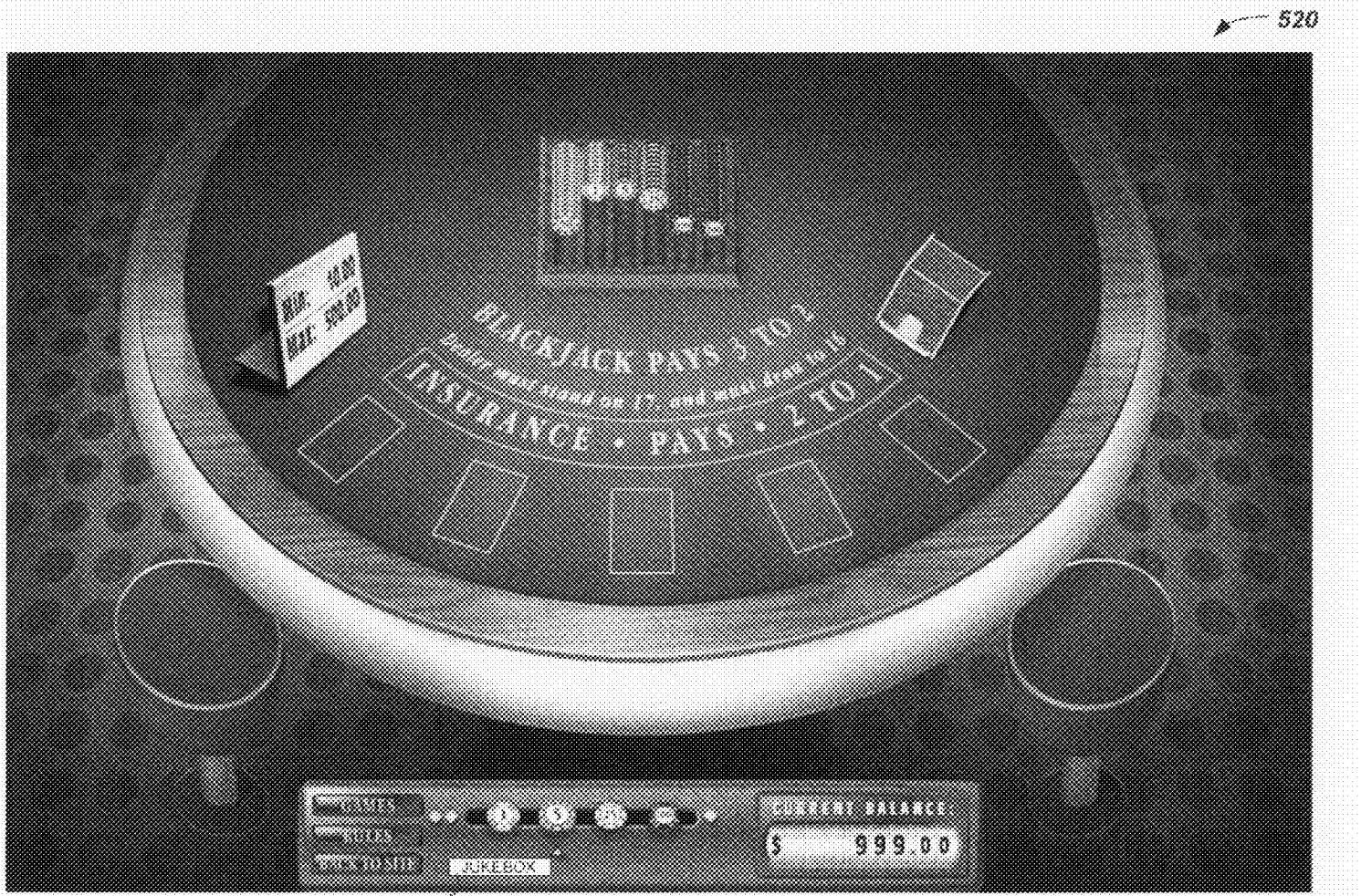
FIG. 3 is a screenshot of an exemplary online casino gaming web page according to the present invention.
Figure 4:
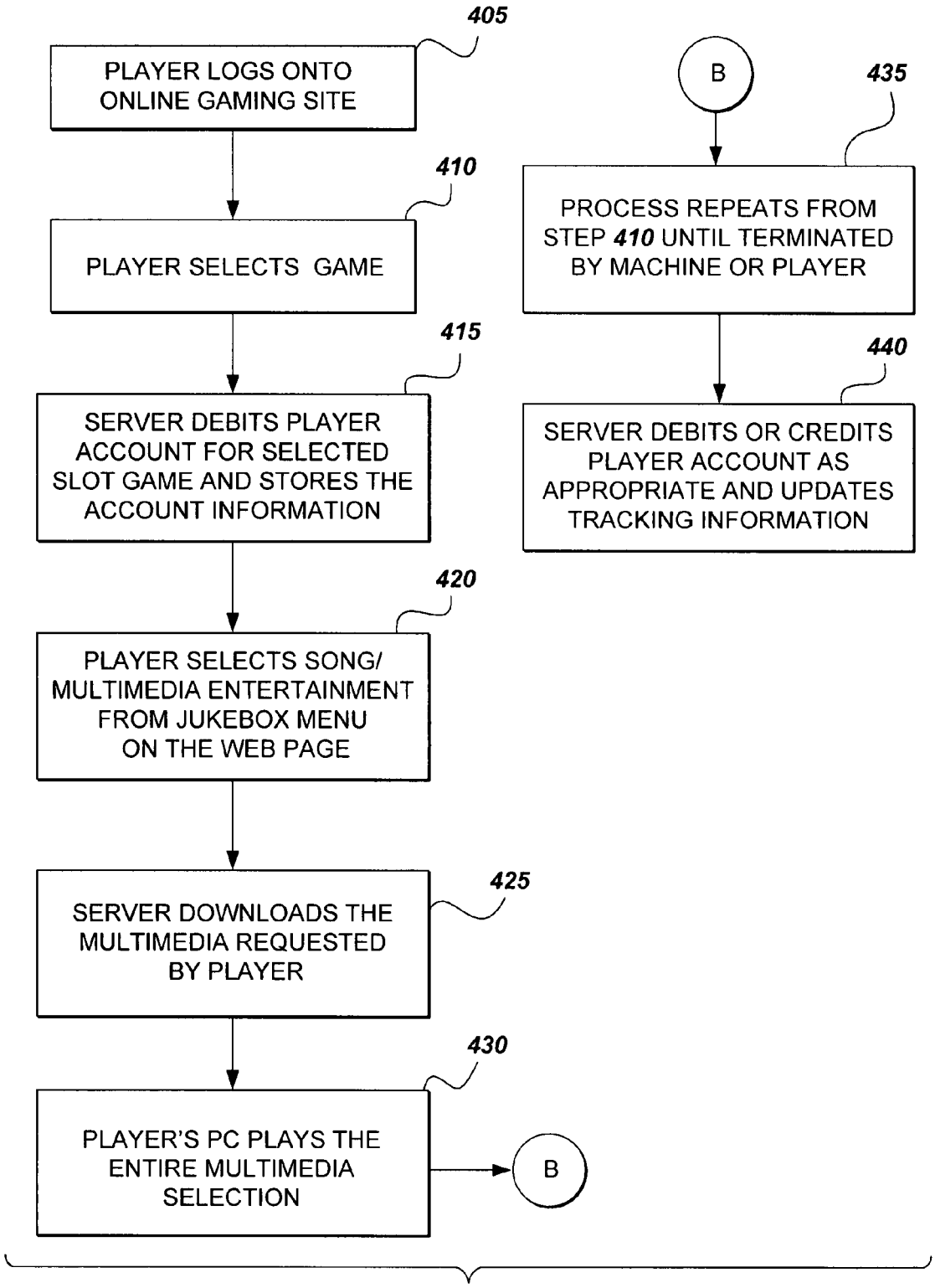
FIG. 4 is a flowchart of a method for providing a jukebox for an online casino gaming machine, according to the present invention.
Figure 5:
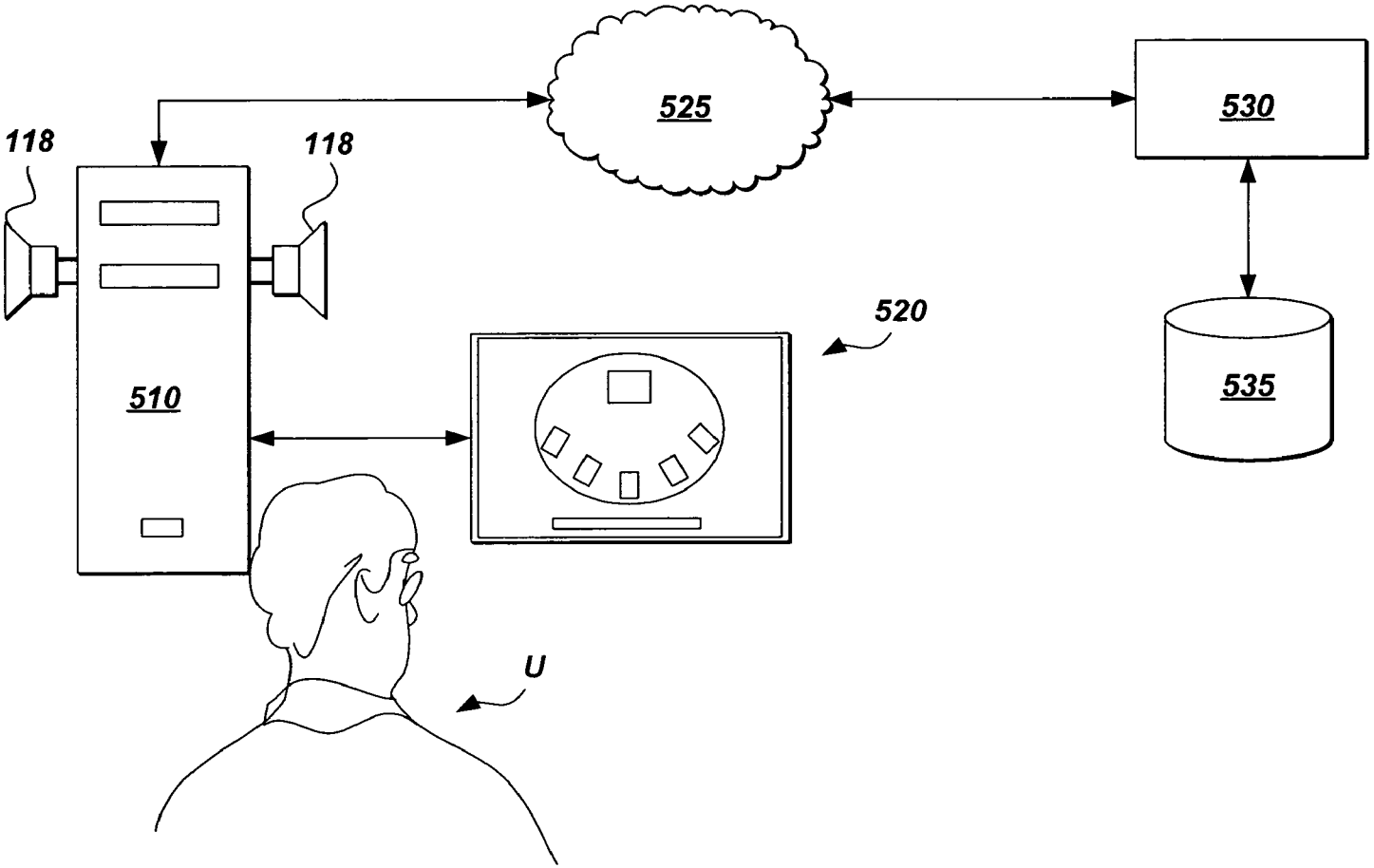
FIG. 5 is a block diagram of a system for a jukebox for an online casino gaming machine according to the present invention.

As shown in FIGS. 3 through 5, an online version of the jukebox on a casino gaming machine provides a web page 520 to allow user U to select and experience an entertainment program in its entirety during operational modes of a gambling game on a web-enabled device, such as personal computer 510. The online embodiment of the present invention generally comprises a gambling game server 530 having database storage 535 that may contain player account information, as well as a jukebox function comprising music, graphics and themes. Server 530 is capable of serving for presentation on a client such games as, but not limited to, Trivia, Backgammon, Blackjack, Roulette, Craps, Poker, Video Poker, Sci Bo, Red Dog Slots, Keno, and the like.

Communication with a user's web-enabled device, such as, but not limited to, a personal computer 510, is provided via the Internet 525. The user U can play the game by viewing a display and listening through a headset (not shown), or speakers 118.

As shown in FIG. 3, the server 530 may present a gambling game web page 520. The software provides a jukebox radio button 310 that the user may select for a menu of selectable jukebox items, i.e., entertainment programs.

As shown in FIG. 4, after the player logs onto the online gaming site at step 405, the player is provided with an option to select a game at step 410. At step 415 the server 530 adjusts and stores the user's account for the selected game. At step 420 the player may select entertainment content, i.e., programs from the web page 520. At step 425 the server 530 downloads the requested entertainment content.

At step 430 the user's web enabled device, such as personal computer 510 plays the entire entertainment content selected by the user. At step 440, after termination of the session, the server 530 adjusts the user's account and tracking information.

It is to be understood that the present invention is not limited to the embodiments described above, but encompasses any and all embodiments within the scope of the following claims.

I claim:

1. A system for providing a jukebox on a casino gaming machine, the system comprising: at least one media playback device adapted for attachment to a casino gaming machine;

a player account storage information database;

a multimedia storage database;

a central server having access to the player account storage information database and the multimedia storage database;

a client adapted for being housed in the casino gaming machine, the client being in operable communication with the central server and the playback device;

a user interface disposed on the gaming machine;

a jukebox player being in operable communication with the server, the server having means for displaying the jukebox player on the client and permitting a user to select a multimedia file from the multimedia database for playback on the playback device; and earphones including a set of earphone plugs having an electronic circuit storing at least a player account identification thereon corresponding to a player account stored in the player account storage information database, the earphones being attachable to the playback device, the server having means for debiting the player's account for playback of a selection from the jukebox player.

* * * * *